United States Patent [19]

Downey

[11] Patent Number: 4,805,753

[45] Date of Patent: Feb. 21, 1989

[54] BI-DIRECTIONAL SELF-RESETTING FORCE TRANSMITTING OVERLOAD ARM

[75] Inventor: Rogers B. Downey, Lexington, Mass.

[73] Assignee: Polaroid Corporation, Cambridge, Mass.

[21] Appl. No.: 454,199

[22] Filed: Dec. 29, 1982

[51] Int. Cl.[4] ..... H01H 21/28

[52] U.S. Cl. ..... 192/150

[58] Field of Search ..... 192/150; 200/47

[56] References Cited

U.S. PATENT DOCUMENTS

| | | | |
|---|---|---|---|
| 1,909,156 | 5/1933 | Williams et al. | 192/150 |
| 2,151,493 | 3/1939 | Acker | 192/150 |
| 2,997,149 | 4/1960 | Seybold . | |
| 3,053,950 | 9/1962 | Dobes | 200/47 X |
| 3,056,586 | 10/1962 | Burrows | 200/47 X |
| 3,236,106 | 2/1966 | Krupp et al. | 192/150 X |
| 3,549,833 | 12/1970 | Horton | 192/150 X |
| 3,584,715 | 6/1971 | Miller | 192/150 X |
| 3,628,393 | 12/1971 | Houk | 74/470 |
| 3,707,212 | 12/1972 | Durand | 192/150 |
| 3,923,283 | 12/1975 | Tomiati | 251/77 |
| 3,955,661 | 5/1976 | Popper et al. | 192/150 |
| 4,111,062 | 9/1978 | Callaghan | 74/470 X |
| 4,293,060 | 10/1981 | Miller | 192/150 X |

FOREIGN PATENT DOCUMENTS

| | | | |
|---|---|---|---|
| 1077764 | 3/1960 | Fed. Rep. of Germany | 200/47 |
| 0226347 | 11/1969 | U.S.S.R. | 192/150 |

*Primary Examiner*—Rodney H. Bonck

*Attorney, Agent, or Firm*—John J. Kelleher

[57] ABSTRACT

Apparatus for limiting the force transmitted in either of two directions includes an overload or excessive force actuated switch that generates an excessive force indicating electrical signal that can be employed for drive source interrupting purposes whenever the force to be transmitted equals or exceeds a predetermined magnitude in either of two force transmitting directions and terminates this electrical signal when the force to be transmitted in either of two directions is less than or is reduced below a predetermined magnitude.

9 Claims, 4 Drawing Sheets

80
94
88
84
76
68
66
70
110
64
108
102
78
86
74
60
72
62
58
82
92
90
14
10
60
92
62
84
76
112
114
34
130
116
122
120
126
118
28
98
104
106
100
30
32
24
20
16
18
22
12
96
26

BI-DIRECTIONAL SELF-RESETTING FORCE TRANSMITTING OVERLOAD ARM

BACKGROUND OF THE INVENTION

The present invention relates to apparatus for limiting the force transmitted by a force transmitting member, in general, and to such apparatus for both limiting such force and to allow for disabling the drive means producing said transmitted force so long as the force to be transmitted exceeds a predetermined magnitude, in particular.

In many applications where force from a drive system is employed to, for example, drive a tool that performs a particular operation on a workpiece or to position a workpiece at an assembly machine workstation, it is desirable to provide means for limiting the force transmitted to the workpiece for such purposes in order to limit potential workpiece damage and/or to avoid the drive system damage that might result if the drive system is excessively overloaded. This is particularly true in an assembly machine having a multiplicity of workstations that derive all of their force requirements from a common force producing drive system. Failure to provide such force limiting means may result in damage to a plurality of successive workpieces and/or in drive system failure produced by, for example, the cumulative effects of several workstation overloads even though the load demands of a single workstation is well within the load handling capability of the drive system.

Numerous force limiting devices have been employed in the past for limiting the force provided by a drive source to less than some predetermined magnitude. One type of force limiting device employs a slip clutch for force limiting purposes while another type of device employs a force coupling spring that changes length to thereby limit transmitted force magnitude when the spring-coupled force exceeds some predetermined magnitude. While these devices served the purpose for which they were intended, they all are subject to certain undesirable limitations. One such limitation is that in these force limiting devices where the driven member is disconnected from the driving member, these members must be manually reconnected after the overload condition that caused these members to be disconnected from one another is removed. Another limitation with such prior art force limiting devices is that the disconnection of a driven member from a drive member occurs when there is an overload condition in one drive force direction only.

A primary object of the present invention is to provide a device for interrupting the drive force to a driven member for a driven member that can be driven in more than one drive force direction.

Another object of the present invention is to provide a device that will automatically restore the interrupted drive force to a driven member in more than one drive force direction once the overload causing said force interruption is removed.

A further object of the present invention is to provide overload sensing apparatus that includes a single overload signal generating electrical switch that will generate an overload signal for an overload occurring in more than one drive force direction.

Other objects, features and advantages of the present invention will be readily apparent from the following detailed description of the preferred embodiment thereof taken in conjunction with the accompanying drawings.

SUMMARY OF THE INVENTION

In accordance with the teachings of the present invention, apparatus is provided for limiting the force that can be applied by a drive member to a driven member in one or more drive force directions so long as the applied force equals or exceeds a predetermined magnitude. The apparatus includes a force sensing device that senses applied force magnitude. The device generates an excessive force indicating signal when the force sensed by the force sensing device equals or exceeds a predetermined magnitude and terminates said signal when the applied force is less than or is reduced below said predetermined magnitude.

DESCRIPTION OF THE PREFERRED EMBODIMENTS

Figures 1, 2:
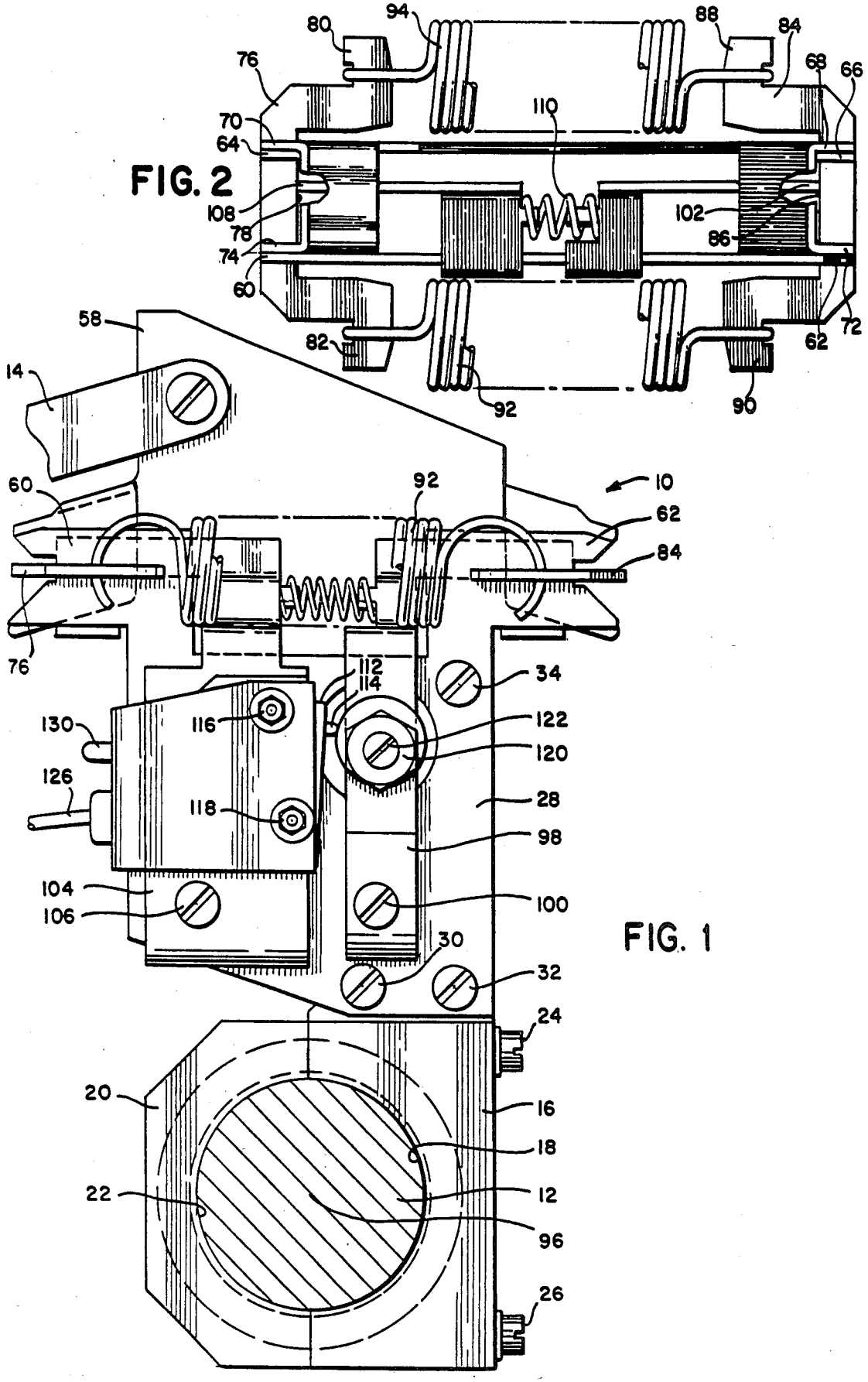
FIG. 1 is an elevational view of the self-resetting force limiting device of the present invention under normal force transmitting conditions.
FIG. 2 is a top view of the elevational view shown in drawing FIG. 1.

In the drawings, FIGS. 1–7 illustrate a preferred embodiment of the self resetting force limiting device of the present invention. Self-resetting force limiting device 10 mechanically couples a source of mechanical force or power (not shown) to, for example, a tool in an assembly machine (not shown) for the purpose of performing a particular operation or task on a workpiece. The force produced by said source of mechanical force is routed to force limiting device 10 through rotatably mounted shaft 12 and this force is, in turn, mechanically coupled to output shaft 14 through said force limiting device 10. When the force differential between input shaft 12 and output shaft 14 equals or exceeds a predetermined magnitude, force limiting device 10 generates an electrical signal that is routed to conventional control circuitry (not shown) that, in turn, can be employed to cause the force produced by said source of mechanical force to be deenergized where, for example, the force is being provided by an electrical motor or other type of electrical energy dependent power source, or to be uncoupled from force limiting device 10 through electrically actuated apparatus such as an electromagnetic clutch.

Figure 4:
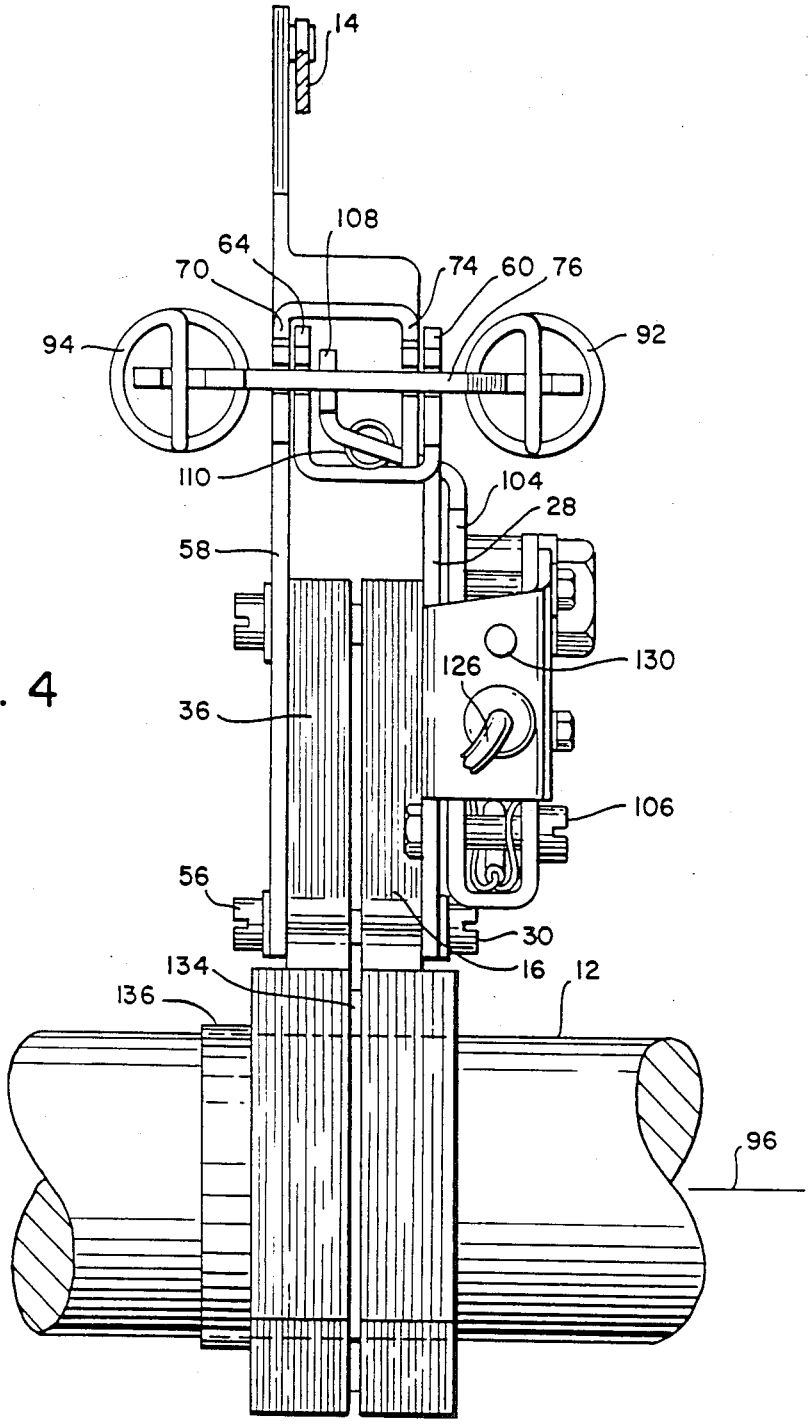
FIG. 4 is a left side view of the elevational view shown in drawing FIG. 1.

Self-resetting force limiting device 10, best shown in drawing FIGS. 1 and 4, includes input plate support 16 having semicircular recess 18 formed in one side thereof that cooperatively engages the outer cylindrical surface of circular cross section input shaft 12. Support 16 includes cap portion 20 having semicircular recess 22 formed in one side thereof that also cooperatively engages the outer cylindrical surface of input or drive shaft 12. Machine screws 24, 26 extend through clearance holes in support 16 and into cooperatively mating threaded holes in cap portion 20 of said support 16 to thereby place input plate support 16 in a fixed position with respect to input shaft 12. Generally rectangular input plate-like member 28 is attached to plate support 16 in a fixed relation, by machine screws 30, 32 and 34 that extend through clearance holes in plate 28 and into cooperatively engaging threaded holes in plate support 16.

Figure 3:
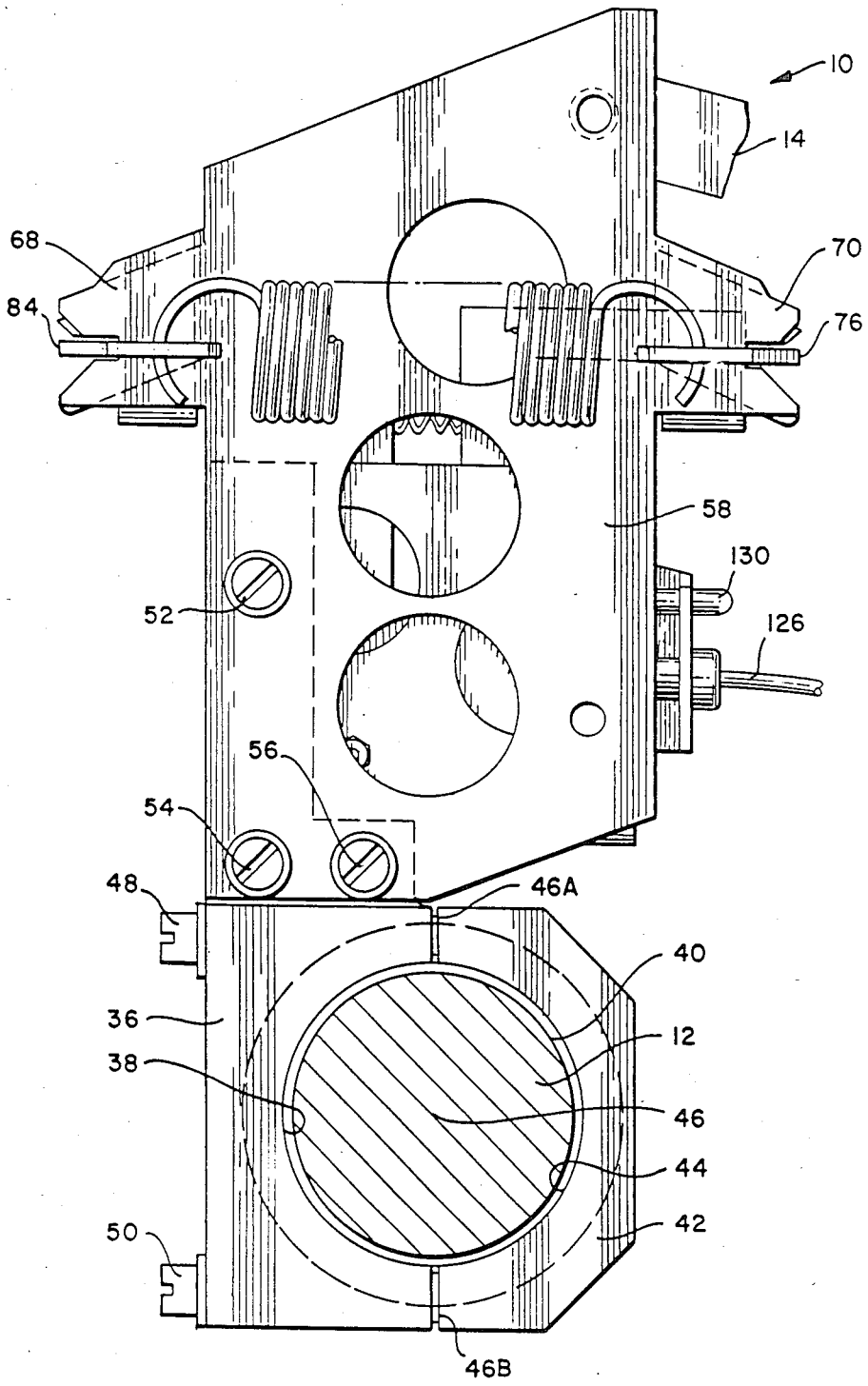
FIG. 3 is a view of the opposite side of the force limiting device of the present invention shown in drawing FIG. 1.

Force limiting device 10 also includes output plate support 36, a structure that is best shown in drawing FIGS. 3 and 4. Support 36, having semicircular recess 38 formed in one side thereof cooperatively engages cylindrically-shaped nylon bearing 40 that is supported on drive shaft 12. Support 36 includes cap portion 42 having semicircular recess 44 formed in a side thereof that also cooperatively engage said cylindrically-shaped bearing 40. Spacers 46A and 46B are positioned between plate support 36 and its cap portion 42. Machine screws 48 and 50 extend through clearance holes in plate support 36, through spacers 46A or 46B and then into cooperatively mating threaded holes in cap portion 42 of said output plate support 36 to thereby rotatably mount plate support 36 on said drive shaft 12. Generally rectangular output plate-like member 58, whose top portion projects above input plate-like member 28 is attached to plate support 36, in a fixed relation, by machine screws 52, 54 and 56 that extend through clearance holes in plate 58 and into cooperatively engaging threaded holes in said plate support 36.

The ends of input plate 28 and output plate 58 distal or remote from their respective plate supports terminate, in part, in a pair of spaced apart, laterally extending yoke-supporting support fingers. Support fingers 60 and 62 (FIG. 1) laterally project from opposite sides of input plate 28. In addition, support fingers 64 and 66 (FIG. 2 and partially in FIG. 4) also laterally project from opposite sides of input plate 28, the outer ends of said fingers 64 and 66 being parallel to and spaced from said support fingers 60 and 62, respectively. Similarly, support fingers 68 and 70 (FIG. 3) laterally project from opposite sides of output plate 58. In addition, support fingers 72 and 74 (FIG. 2 and partially in FIG. 4) also laterally project from opposite sides of said output plate 58, the outer ends of said fingers 72 and 74 being parallel to and spaced from said support fingers 68 and 70, respectively. As shown in drawing FIG. 4, adjacent support fingers of input plate 28 and output plate 58 are inverted, in complementary fashion with respect to one another, to allow bidirectional movement of said input and output plates.

As best shown in drawing FIG. 2, U-shaped yoke 76, formed from a flat steel plate, has a linear edge 78 at its internal center portion and a pair of ears 80, 82 laterally projecting from opposite sides or transverse ends thereof. Linear edge 78 of yoke 76 engages the ends of support fingers 60, 64 of input plate 28 and also engages the ends of support fingers 70, 74 of output plate 58 in a supporting relationship, ends having recesses therein that limit yoke 76 movement along the yoke 76 engaged edges of support fingers 60, 64, 70 and 74. Similarly, U-shaped yoke 84, formed of the same material as said yoke 76, has a linear edge 86 at its internal center portion and a pair of ears 88, 90 that extend from opposite sides or transverse ends of said yoke 84. Linear edge 86 of yoke 84 engages the ends of support fingers 62, 66 of input plate 28 and the ends of support fingers 68, 72 of output plate 58 in a supporting relationship, ends having recesses therein that limit yoke 84 movement along the yoke 84 engaged edges of support fingers 62, 66, 68 and 72.

The curved ends of preloaded overload spring 92 engage relative motion limiting recesses in projecting ears 82 and 90 of yokes 76 and 84, respectively, and the curved ends of preloaded overload spring 94 engage relative motion limiting recesses in projecting ears 80 and 88 of yokes 76 and 84, respectively thereby placing springs 93 and 94 outside of or exteriorly of force limiting device 10. With preloaded springs 92 and 94 engaging yokes 76 and 84 in this manner and yokes 76 and 84 engaging said laterally projecting fingers of input plate 28 and output plate 58, relative rotation of input plate 28 with respect to output plate 58 about drive shaft axis 96 (FIGS. 1, 3 or 4) is precluded for force differentials between input plate 28 and output plate 58 equal to or less than the preload force provided by said overload springs 92 and 94.

Significant rotational movement of input plate 28 with respect to output plate 58 is considered an overload condition and such movement is determined by monitoring the relative movement of input and output plate engaged yoke 76 with respect to input and output plate engaged yoke 84 and then generating an electrical signal that is representative of an overload condition between said input plate-to-output plate movement. Electrical signal generation responsive to such relative yoke member movement is produced in the following manner.

As best shown in drawing FIGS. 1, 2 and 4, one end of L-shaped follower arm 98 is pivotally mounted on input plate 28 by machine screw assembly 100 with its distal end 102 (FIG. 2) opposite its said pivotally mounted end being between input plate 28 and output plate 58 and in butting engagement with edge 86 of yoke 84. Similarly, one end of L-shaped follower arm 104 is pivotally mounted on input plate 28 by machine screw assembly 106 with its end 108 (FIG. 2 and particularly FIG. 4) opposite its said pivotally mounted end being between input plate 28 and output plate 58 and in butting engagement with edge 78 of yoke 76. Bias force providing coil spring 110 (FIGS. 2 and 4) whose ends are captured by opposed projections from follower arms 98 and 104, urge ends 102 and 108 of said arms 98 and 104, respectively, into motion-following engagement with said yokes 84 and 76, respectively.

In drawing FIG. 1, microswitch 112 having microswitch actuator 114 projecting therefrom is attached, in a fixed relation, to rotatably mounted follower arm 104 by means of mounting screw assemblies 116 and 118. In addition, eccentrically mounted cam actuator 120 is adjustably mounted in a fixed relation to rotatably mounted follower arm 98 by means of mounting screw assembly 122. Actuation of microswitch 112 results from relative movement between cam actuator 120 and microswitch actuator 114. As schematically shown in drawing FIG. 5, single-pole, double-throw microswitch 112 is biased in the open circuit position by the engagement of spring-loaded microswitch actuator 114 with cam actuator 120. When motion of either microswitch actuator 114 or cam actuator 120 occurs, producing sufficient movement of these actuators away from one another, spring-loaded, single-pole microswitch 112 will be actuated to its closed circuit position. When microswitch 112 is so actuated to its closed circuit position by microswitch 112 or cam actuator 120 movement, a suitable source of potential (not shown) attached to electrical conductor 124 within cable 126 is connected to electrical conductor 128 (also within cable 126) by microswitch 112, thereby producing a potential on conductor 128 whose presence thereon is an electrical signal indicating an overload condition between input plate 28 and output plate 58. At the same time that microswitch 112 connects a source of electrical potential to conductor 128, it also connects the same source of potential to visual overload-indicating lamp 130 that has one of its two input leads permanently connected to a low potential point (normally ground) through conductor 132 of said cable 126.

OPERATION

Figures 5, 6, 7:
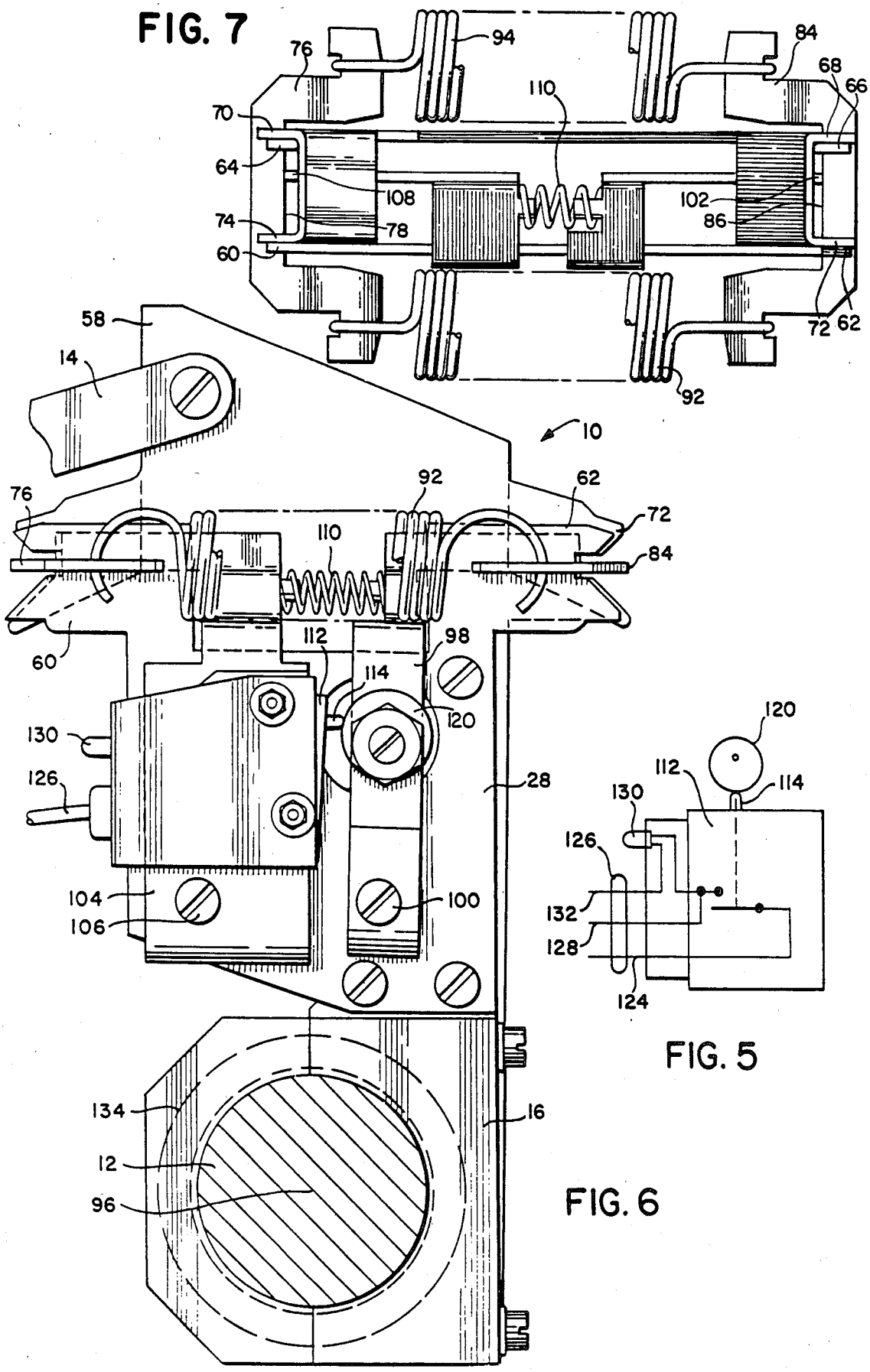
FIG. 5 is a schematic diagram of the overload signal generating switch included in the force limiting device of the present invention.
FIG. 6 is an elevational view similar to that of FIG. 1 of the self-resetting force limiting device of the present invention shown under force limiting or overload conditions.
FIG. 7 is a top view of the elevational view shown in drawing FIG. 6.

In operation, self-resetting force limiting device 10 functions in the following manner. FIGS. 6 and 7 of the drawings are elevational and top views of said device 10 shown in a force-limiting or overload condition. With reference to FIGS. 6 and 7 and as viewed in said FIG. 6, a force is applied to input plate support 16 and ultimately to input plate 28 by the counterclockwise rotation of drive shaft 12 about drive shaft axis 96, said support 16 and plate 28 being attached to said shaft 12, in a fixed relation, in the previously described manner. In this particular instance, the force differential between the resistive force of the load being driven by arm 14 through output plate 58 and a larger force being applied to input plate 28 by drive shaft 12 exceeds the preload of force-limiting or overload springs 92 and 94, thereby causing input plate 28 which overlaid plate 58 or was aligned therewith to be rotated about drive shaft axis 96 and out of alignment with output plate 58 while said plate 58 is held in a relatively fixed position by the resistive load on arm 14. Plate 28 movement is along a path that is parallel to the path traversed by flat output plate 58 under normal non-overload conditions. Flat nylon bearing 134 reduces the friction between input plate support 16 and output plate support 36 when such relative input plate-to-output plate rotation occurs. Clamp collar 136 (FIG. 4) limits plate support member 36 movement along shaft 12 away from plate support member 16. This overload-produced relative rotation between input plate 28 and output plate 58 causes support fingers 68 and 72 of output plate 58 to move yoke 84 away from support fingers 62 and 66 of input plate 28 which had been in supporting engagement with said yoke 84 prior to such relative input plate 28-to-output plate 58 rotation. When such yoke 84 movement occurs, L-shaped arm 98 rotates in a clockwise direction about machine screw assembly 100 as its end 102, that is spring force biased in butting engagement with edge 86 of yoke 84, follows said yoke 84 movement. When yoke 84 motion-following arm 98 rotates in a clockwise direction about machine screw assembly 100, cam actuator 120, mounted thereon, moves away from spring force biased microswitch actuator 114, thereby causing microswitch 112 to be actuated to its closed circuit position. As explained above, with respect to FIG. 5, when microswitch 112 is actuated to its closed position, an electrical signal is generated on conductor 128 which may be employed, in a conventional manner (not shown), to either disengage or disable the source of power providing the drive force to drive shaft 12.

Similarly, if input plate 28 is rotated in a clockwise rather than in a counterclockwise direction about drive shaft rotational axis 96 by a suitable force on drive shaft 12 while output plate 58 is held in a relatively fixed position by the resistive force of the load being driven by arm 14 through output plate 58, a force differential is assumed to be established between input plate 28 and output plate 58 that is large enough to exceed the preload force of force limiting overload springs 92 and 94 and produce relative rotation between said plates 28 and 58. This overload-produced relative rotation between input plate 28 and output plate 58 causes support fingers 70 and 74 of output plate 58 to move yoke 76 away from support fingers 60 and 64 of input plate 28 which were in supporting engagement with said yoke 76 prior to such relative input plate 28-to-output plate 58 rotation. When such yoke 76 movement occurs, L-shaped arm 104 rotates in a counterclockwise direction about machine screw assembly 106 as its end 108, that is spring-force biased in butting engagement with edge 78 of yoke 76, follows said yoke 76 movement. When yoke 76 motion following arm 104 rotates in a counterclockwise direction about screw assembly 106, microswitch 112, mounted thereon, moves away from cam actuator 120 on L-shaped arm 98 which causes microswitch 112 to be actuated to its closed circuit position by the spring force bias on microswitch actuator 114. As explained above with respect to the clockwise rotation of L-shaped arm 98 and cam actuator 120 mounted thereon, when said microswitch 112 is actuated to its closed position, an electrical overload signal is provided in the same manner as that described above with respect to the actuation of microswitch 112 by the said clockwise rotation of L-shaped arm 98.

It should be noted that the length of the laterally projecting fingers of plate-like members 28 and 58 are such that they do not cause rotation of said yokes 76 and 84 about said plates 28 and 58 during engagement and disengagement with said laterally projecting fingers. The movement of yokes 76 and 84 with respect to one another during such engagement is such that linear edge 78 of yoke 76 remains parallel to linear edge 86 of yoke 84 during such relative yoke movement in order to maintain the same previously established relationship between yoke movement and overload signal generation.

Whenever the force differential between input plate 28 and output plate 58 is reduced to or below the preload force provided by force limiting overload springs 92 and 94, microswitch actuator 114 or cam actuator 120 move toward and engage one another thereby actuating switch 112 to its open circuit position. When switch 112 is actuated to its open circuit position, the electrical overload signal is removed from conductor 128 and conventional means (not shown) responsive to the removal of said overload signal from conductor 128 can be employed to automatically reconnect or energize the power source (not shown) providing the drive force to drive shaft 12.

As explained above with respect to drawing FIG. 5, when single-pole microswitch 112 is actuated to its closed position which can occur either by the relative movement of cam actuator 120 away from microswitch 112, or vice versa, a voltage source is connected to overload indicating lamp 130 by said microswitch 112, the illumination of said lamp 130 visually indicating when an overload condition is present. Conversely, when the overload condition is removed and microswitch 112 is actuated to its open position by the movement of L-shaped follower arms 98 and 104 towards one another, the visual overload indication provided by lamp 130 is thereby terminated.

Cam actuator 120 is adjustably mounted, in a fixed position, on rotatably mounted L-shaped follower arm 98 as previously explained. The reason for such adjustable cam actuator 120 mounting is to permit adjustments for differences between the point where yoke 76 or yoke 84 mechanical movement begins and the point where the actuation of microswitch 112 is initiated. These two points do not necessarily coincide. In this particular application of the preferred embodiment of the inventive concept of the present invention, the actuation of microswitch 112 is made to occur after yoke 76 or yoke 84 has moved a predetermined distance beyond that where said yokes 76 or 84 movement was first initiated. This delay in the actuation of microswitch 112 is introduced in order to reduce the sensitivity of overload device 10 to spurious overload forces. Cam actuator 120 is eccentrically mounted on arm 98 and the actuation point of microswitch 112 is set by loosening the screw assembly that attaches actuator 120 to arm 98 and then rotating said actuator 114 is in engagement with the outer surface of cam actuator 112 until the desired microswitch 112 actuation point is obtained. Once this point is obtained, cam actuator 120 is once again secured, in a fixed relation, to L-shaped arm 98.

Yoke motion following L-shaped arms 98 and 104 are pivotally mounted on input plate 28 and cam actuator 120 and microswitch 112 are respectively mounted thereon, as previously noted. By mounting arm 98, arm 104, microswitch 112 and cam actuator 120 in this manner, it is possible to use a single switch to provide an overload indication for overloads occurring in opposite drive force directions. By contrast, if arm 104 and microswitch 112 were mounted on input plate 28 and arm 98 and cam actuator 120 were mounted on output plate 58, for example, at least two switches would be required to provide such bidirectional overload indications. In addition, it would be significantly more difficult to provide the overload sensitivity adjustment capability that results when the sensitivity adjusting mechanism is mounted on the same support member than it would be if more than one support member were employed.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Drive coupling apparatus comprising:

an input member configured for coupling to a power drive;

an output member configured for coupling to a work load;

means for mounting said members for relative movement of at least a given portion thereof along parallel paths, at least said given portion of said members being extended in a direction parallel to said path; and means for biasing said extended portion of said members into a given location overlying each other and for resisting displacement of said members therefrom along said parallel path, said biasing means including a pair of yokes mounted respectively at the extended portions of said input and output members and tensioning means for biasing said yokes toward each other and into engagement with said extended portions so as to urge said input and output members toward said given location, said tensioning means including a pair of tension springs mounted alongside the exterior surfaces of said extended portions of said input and output members in connection with one transverse end of each of said yokes.

2. Drive coupling apparatus comprising:

an input member configured for coupling to a power drive;

an output member configured for coupling to a work load;

means for mounting said members for relative movement of at least a given portion thereof along parallel paths, at least said given portion of said members being extended in a direction parallel to said path, means for maintaining a transverse separation between said extended portions; and means for biasing said extended portion of said members into a given location overlying each other and for resisting displacement of said members therefrom along said parallel path, said biasing means including a pair of yokes mounted respectively at the extended portions of said input and output members and tensioning means for biasing said yokes toward each other and into engagement with said extended portions so as to urge said input and output members toward said given location, and each of said input and output members including at their extended portions, an arm which extends from one member across said transverse separation into close proximity with the other member and which defines thereat an edge portion substantially coplanar with an end edge of its respective member to thereby provide a laterally balanced engagement of each said member with its associated yoke member.

3. The apparatus of claim 2 wherein each of said arms is a generally L-shaped member having a first leg extending from the one member upon which it is mounted toward the other member and with the second leg thereof extending parallel to said other of said input and output members and with an exterior edge portion of each said second leg being at least in part coplanar with the extended portion of its respective input and output members so as to provide a laterally balanced engagement of each of said members with its associated yoke member.

4. The apparatus of claim 3 wherein at each extended portion of said input and output members, one of said extended portions is inverted in complementary fashion with respect to the other to allow bidirectional movement of said input and output members.

5. The apparatus of claim 4 wherein said tension means includes a pair of tension springs mounted alongside the exterior surfaces of said extended portions of said input and output members in connection with one transverse end of each of said yokes.

6. Drive coupling apparatus comprising:

an input member configured for coupling to a power drive;

an output member configured for coupling to a work load;

means for mounting said members for relative movement of at least given portions thereof along parallel paths wherein said input and output members extend in the direction of said paths;

means for biasing said portions of said members into a given location overlying each other and for resisting displacement of said portions along said paths away from said given location, said biasing means including at least one tensioning element and a pair of yoke members mounted at opposed ends of said extended input and output members and urged into engagement therewith by said tensioning element; and signal means responsive to the relative displacement of said member portions a given distance in either direction from said given location for producing a signal indicating an overload of said members, said signal means including a switch unit and an actuator independently mounted on one of said members in operative relation to each other and in follower relation with respective ones of said portions of said members, with said switch unit and actuator being respectively coupled in follower relation to said yoke members such that as displacement of said input and output members increases the separation between said yoke members against the tension of said tensioning element, the separation between said switch unit and actuator are also accordingly increased.

7. The apparatus of claim 13 wherein the ends of said yoke members extend transversely beyond the sides of said input and output members, and said biasing means includes a pair of tension springs mounted respectively exteriorly of said input and output members in coupled arrangement to the said extended ends of said yoke members.

8. The apparatus of claim 13 wherein said input and output members are plate-like members configured at one end for mounting for pivotal movement along said parallel path while maintaining a transverse separation at a second distal end, said yoke members being mounted at said distal ends and extending transversely across adjoining edges of said input and output members, said switch unit including a switch mounted on a first arm member which is pivotally mounted at one end on one of said input and output members with the distal end of said first arm member being positioned within said separation between said input and output members, said actuator including a second arm member mounted on said one of said input and output members with the distal end of said second arm member being positioned within said separation between said input and output members, and spring means for urging said distal ends of said first and second arm members into engagement with respective yoke members whereby said first and second arm members are maintained in follower relation to said yoke members.

9. Drive force controlling apparatus comprising:

an input member adapted for mounting in a fixed position with respect to a drive member;

an output member adapted for coupling to a workload and for movable mounting with respect to said input member, wherein said input and output members are a pair of spaced apart plate members mounted for rotation about one end thereof;

input member-to-output member coupling means for precluding relative input member-to-output member movement in either of two directions for differential forces between said input member and said output member less than a predetermined magnitude, said coupling means including a pair of spaced-apart yoke members, each of which engages a side of each plate member at the plate member ends remote from their said mounted ends and a pair of springs coupled to each of said yoke members for maintaining said yoke members in engagement with said plate members, the combined spring force of said springs precluding relative input plate member-to-output plate member movement for differential forces between said input and output plate members of less than said predetermined magnitude; and means responsive to relative input member-to-output member movement for generating an overload signal whenever a portion of said input member moves a predetermined magnitude relative to a portion of said output member and for precluding the generation of said overload signal whenever the relative movement between said input member portion and said output member portion is less than said predetermined magnitude, wherein said overload signal generating means includes a pair of follower arms each havings one end thereof mounted on the same plate member and each having their opposite ends spring-force biased against one of said yoke members with a mechanically actuatable electrical switch being mounted on one follower arm and a switch actuator being mounted on the other of said follower arms such that a predetermined minimum amount of relative movement between said plate member engaged yoke members causes switch actuating follower arm movement thereby producing an electrical signal at a terminal of said switch indicating that a drive force magnitude in excess of that capable of being transmitted by said drive force controlling apparatus is being applied to said input plate member, said signal persisting so long as said predetermined minimum amount of relative yoke member movement is maintained.

* * * * *